United States Patent [19]

Genest et al.

[11] Patent Number: 4,646,080

[45] Date of Patent: Feb. 24, 1987

[54] METHOD OF CODE CHANGING FOR ELECTRONIC LOCK

[75] Inventors: Leonard J. Genest, 1061 Tropic La., Santa Ana, Calif. 92705; James F. Calvagna, Anaheim, Calif.

[73] Assignee: Leonard J. Genest, Santa Ana, Calif.

[21] Appl. No.: 611,221

[22] Filed: May 17, 1984

[51] Int. Cl.[4] ..... G08C 13/00

[52] U.S. Cl. ..... 340/825.31; 361/172; 70/278; 340/825.3

[58] Field of Search ..... 361/171, 172; 340/542, 340/825.31, 825.32, 825.33, 825.3; 307/10 AT; 70/277, 278

[56] References Cited

U.S. PATENT DOCUMENTS

| | | | |
|---|---|---|---|
| 3,622,991 | 11/1971 | Lehrer et al. | 340/825.31 |
| 3,800,284 | 3/1974 | Zucker et al. . | |
| 3,821,704 | 6/1974 | Sabsay . | |
| 3,860,911 | 1/1975 | Hinman . | |
| 3,926,021 | 12/1975 | Genest et al. . | |
| 4,157,534 | 6/1979 | Schachter | 340/825.31 |
| 4,213,118 | 7/1980 | Genest et al. . | |
| 4,218,690 | 8/1980 | Ulch . | |
| 4,392,133 | 7/1983 | Lundgren . | |
| 4,396,914 | 8/1983 | Aston . | |
| 4,511,946 | 4/1985 | McGahan | 361/172 |

*Primary Examiner*—Ulysses Weldon

*Attorney, Agent, or Firm*—Nilsson, Robbins, Dalgarn, Berliner, Carson & Wurst

[57] ABSTRACT

A combination changing method is used in an access control system which includes one or more keys encoded at a central console with a function information code, a key identification information code, an operation select information code and a two-field key combination information code and one or more locks having at least one memory level in which a lock identification information code and a lock combination information code are stored. A key is initially inserted into a selected lock and the data from the key is transferred to the lock. The lock identification information code is first compared with the key identification information code. If there is no correspondence, power to the lock is turned off for a set period of time. If the identification information codes correspond, a test field of the key combination information code is compared with the lock combination information code. If these correspond, the lock opens. If the identification information codes correspond but the test field of the key combination information code and the lock combination information code do not, then the operation select information code is used to select from a predefined set of operations (logical and/or arithmetic and/or other). The operation selection is then performed on an operand field of the key combination information code. This results in a computed combination information code which is compared with the lock combination information code. If this comparison is successful, the test field of the key combination information code is stored in the lock in place of the lock combination information code and the lock opens.

10 Claims, 5 Drawing Figures

METHOD OF CODE CHANGING FOR ELECTRONIC LOCK

BACKGROUND OF THE INVENTION

This invention relates to methods of operating a security system and more particularly to a method for opening and changing the combination of specific security devices in the security system.

Numerous electronic security lock systems have been developed wherein specific locks are operable in response to a key coded with combination information. Such coded keys are inserted into a lock which reads and compares that information with prestored combination information in the lock. If correspondence exists, then the lock opens.

However, quite typically, in order to change the lock combination information, the individual lock combinations in each door must be reset manually by changing switches or electrical connections before a new coded key will operate the lock.

Several different approaches have been tried. For example, in one type of electronic lock system, a central console is electrically connected to each of the individual door locks. The central control unit is then used to remotely set and change the combination information for the individual locks as well as to sense a combination code on a key inserted into the lock. However, such systems are vulnerable to system failure since a failure of the central console will cause all of the locks to become inoperable. Furthermore, such systems require that each individual lock be electrically wired to the central control unit resulting in greatly increased expense particularly when retrofitting older buildings.

In another type of electronic lock system, combination information of the lock can be changed or otherwise replaced by information on the coded key inserted into the lock. For example, in Hinman et al., U.S. Pat. No. 3,860,911, a coded key actuated automatic code changing system is described whereby each lock unit includes a key decoder with a functionally assigned pair of registers containing prestored combination codes. The first register of the pair stores a current combination code. The other register of the pair stores a next or change combination code. When a key coded with both the current and the change combination codes is inserted, the current combination code carried by the key is compared with the data stored in each register. If a comparison is made with the first register or the second register an appropriate access enable signal is provided. In addition, if a comparison is made with the second register the change combination code in the second register is transferred to the first register thus becoming the current combination code; and a new next combination code, also on the key, generated in and provided for the key in a control console, is inserted in the second register. A somewhat similar code changing system is disclosed in Zucker et al., U.S. Pat. No. 3,800,284, in which combination codes are generated in the locks in correspondence with codes generated in the central station.

Still another code changing system is disclosed in Sabsay, U.S. Pat. No. 3,821,704 (reissued as U.S. Pat. No. Re. 29,259), wherein the key includes an unlock combination code and an authorization code and each lock has stored therein a combination code. If the key unlock combination corresponds to the combination code in the lock, then the lock opens. However, if the key unlock combination does not correspond to the combination code stored in the lock, the authorization code from the key is compared with the combination code from the lock. If correspondence occurs then the key unlock combination code is transferred to the lock and stored in place of the previously stored combination code.

Yet another combination changing system is disclosed in Genest et al., U.S. Pat. No. 4,213,118, wherein each code combination stored in a lock has a first and second field and each key card contains a code combination having a first and second field. When the key is inserted into the lock the two fields of the stored combination code and the combination code from the key are compared and the lock opens if correspondence exists. If correspondence does not exist then the second field of the stored combination code and the first field of the key combination code are compared. If there is correspondence at this stage an appropriate signal is generated to store the two fields of the key combination code in the lock memory in place of the two fields of the stored combination code thereby updating the combination of the lock.

In Aston, U.S. Pat. No. 4,396,914, a new combination code is generated in a lock using information from the key and from the lock. A combination code on the key is compared to the lock combination code. If there is a match, the lock opens. If there is not a match, the new combination code is generated by inverting selected bits of the lock combination code, according to information on the key. If there is a match, the new combination code replaces the lock combination code and the lock opens.

Genest et al., U.S. Pat. No. 3,926,021 (reissued as U.S. Pat. No. Re 29,846), exemplifies, along with other of the above patents, the use of differing keys (e.g., guest, maintenance and master) to address different parts of the lock memory. Ulch et al., U.S. Pat. No. 4,218,690, and Lundgren, U.S. Pat. No. 4,392,133 are also of some limited, peripheral interest.

The present invention employs key information for use in making an operation selection, from a number of available alternative selections, which is then carried out in a security device in order to determine whether combination information in the device should be changed and the device should be opened. This feature and other significant features provide important increments of additional security.

SUMMARY OF THE INVENTION

A method of operating an electronic security device having multiple memory levels includes the steps of storing a lock combination information code in each of the multiple memory levels, applying a key operation select information code and a key combination information code to the security device, and selecting one of the memory levels having stored therein a lock combination information code. Combination information from the selected lock combination information code is compared with combination information from the key combination information code, and a first opening compare signal is generated when such combination information from the selected lock combination information code corresponds to such combination information from the key combination information code. The security device is opened if the first opening compare signal is generated. If, in response to such comparing, the first opening compare signal is not generated, an operation selection is made from a set of predefined operations, based upon the key operation select information code, and this operation selection is applied to combination information from the combination code information to generate a computed combination information code. This computed combination information code is then compared with information from the combination code information, and a second opening compare signal is generated if there is correspondence. The security device is opened if the second opening compare signal is generated.

The operation selection may include one or more arithmetic operations and/or logical operations and/or other operations.

BRIEF DESCRIPTION OF THE DRAWINGS

A complete understanding of the present invention and of the above and other advantages thereof may be gained from a consideration of the following detailed description taken in conjunction with the accompanying drawings in which.

DETAILED DESCRIPTION

The present invention is a method for changing the lock combination of one or more locks for securing limited access areas such as the rooms in a hotel. In general, each limited access area will have a lock which is operable in response to a coded key electronically read by the lock. Data from the coded key is compared with data stored in the lock and a decision is made as to whether the lock should be opened or not. Electronic lock systems of the general type which are particularly adaptable to the use of the method of the present invention include the systems disclosed in U.S. Pat. No. 3,926,021 (reissued as U.S. Pat. No. Re. 29,846), U.S. Pat. No. 4,213,118 and U.S. Pat. No. 4,283,710.

Figure 1:
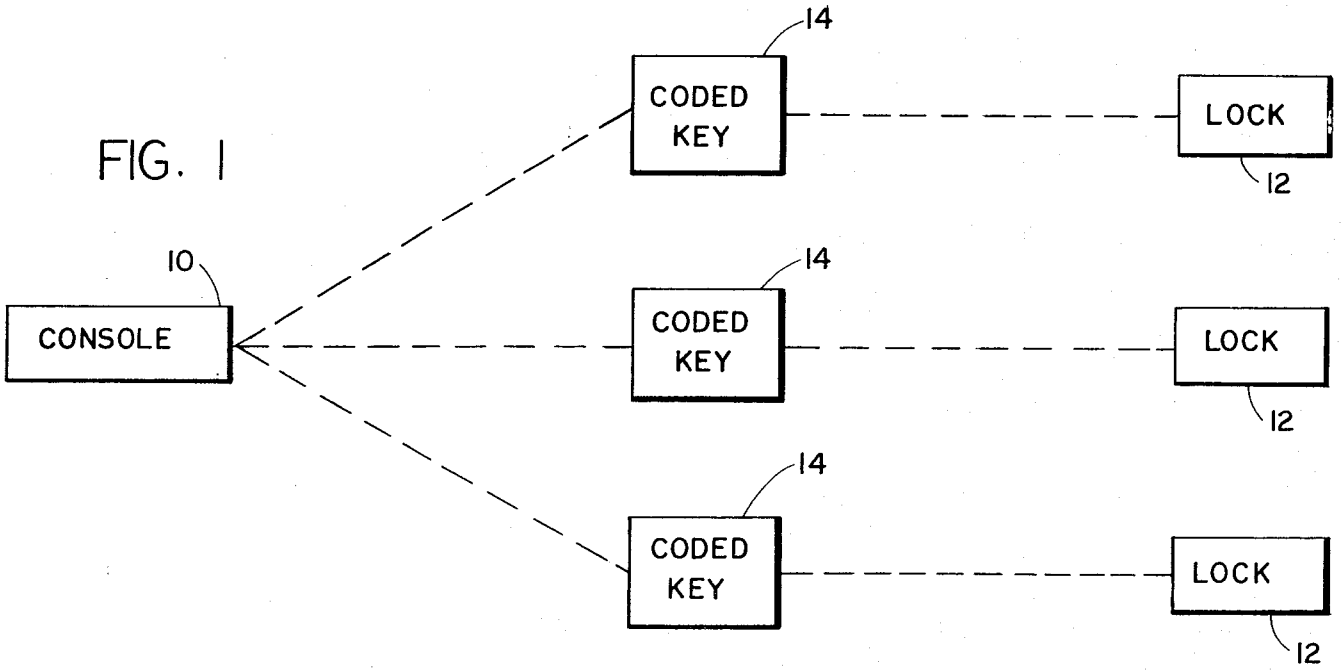
FIG. 1 is a simplified block diagram of a security system in connection with which the method of the present invention may be used.

Systems in connection with which the method of the present invention will be useful may be represented as shown in FIG. 1. Specifically, such systems include a central console 10 which generates and stores all of the combination information codes, identification information codes, function information codes and operation select information codes required for each of a plurality of locks 12. Each lock 12 stores an identification information code and a combination information code for each of a plurality of memory levels in the lock. The central console transfers the required data for a selected lock to a coded key 14 such as a key card or other electronic storage device which is given into the possession of the individual or individuals authorized to have access to a limited access area secured by one of the locks 12. The coded keys 14 may be encoded in any of a number of different ways either by the central console 10 or by some external coding mechanism which cooperates with the central console 10 so that the data stored on a coded key 14 for a particular lock 12 will correspond to the data stored in the central console 10 for that particular lock 12.

Figure 2A:
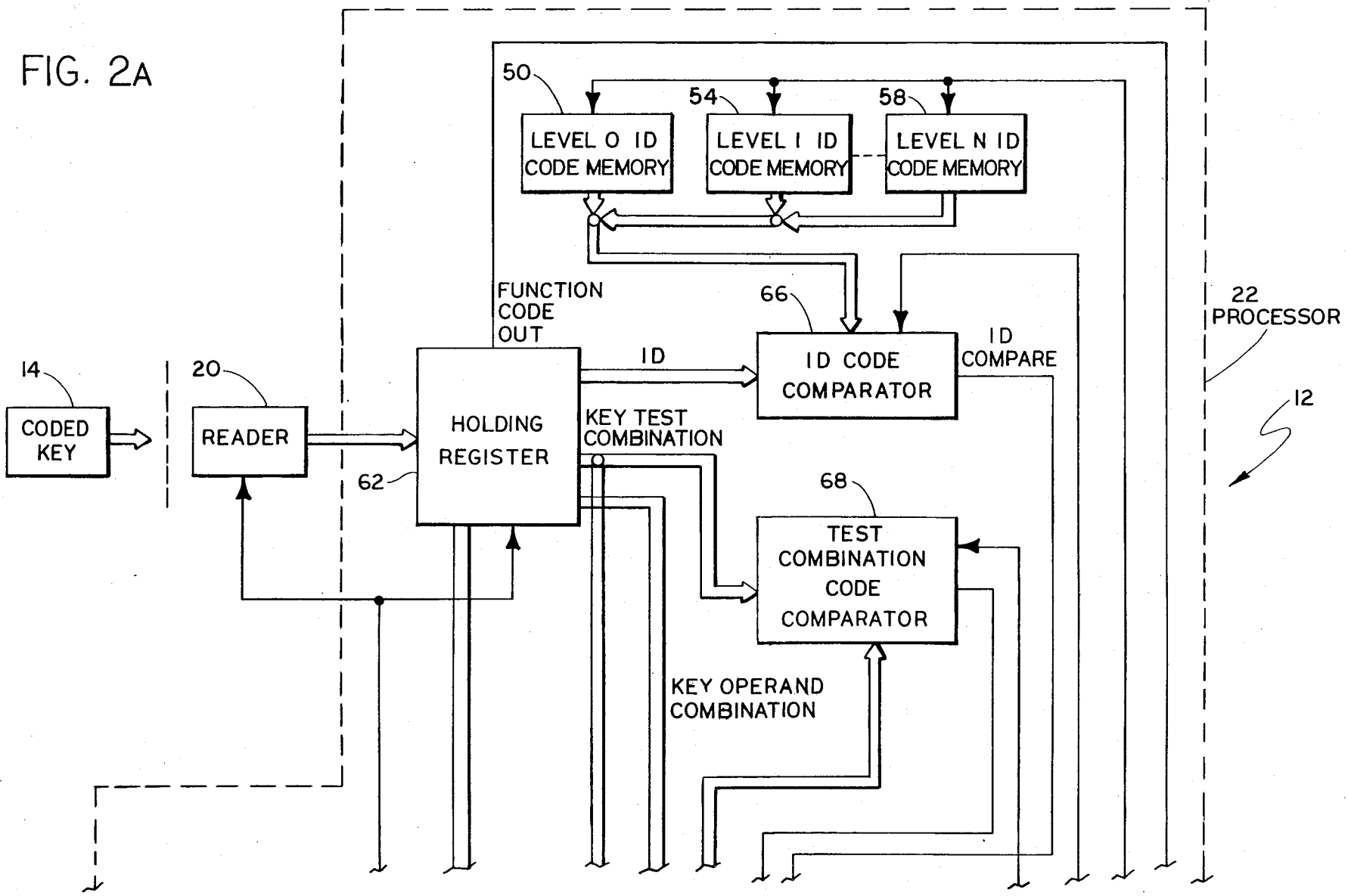
FIGS. 2A and 2B are a functional block diagram of a security device interconnected to operate in accordance with the method of the present invention.
Figure 2B:
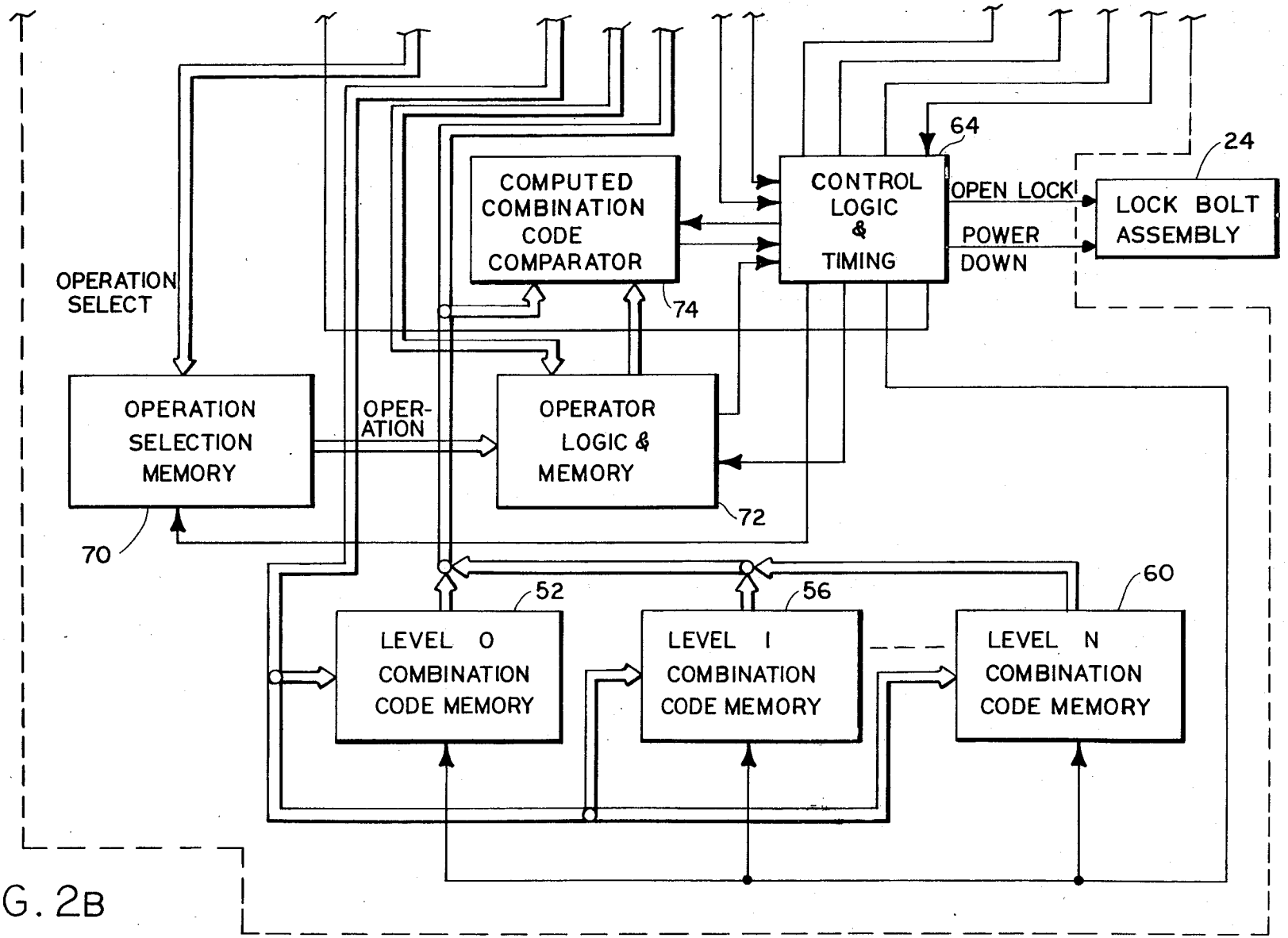

Referring to FIGS. 2A and 2B, the operational elements and interconnections required to enable the electronic lock to operate in accordance with the method of the invention is illustrated. Each such lock 12 includes a key reader 20, and a lock bolt assembly 24 which is operable to mechanically move a bolt to allow accessing to an area secured by the lock bolt assembly 24. Although the electronic processor 22 will preferably be a special purpose processing unit having the necessary memory and processing logic, as has generally become a conventional approach in electronic lock systems, various functional blocks have been illustrated in FIGS. 2A and 2B to facilitate explanation of the method in accordance with the invention.

Each lock 12 is provided with one or more memory levels, each for storing an identification information code and a combination information code. Each memory level represents a different level of access for that particular lock. For example, the level 0 identification information code and combination information code may be common to all locks in a hotel so that data on a coded key which corresponds to the identification information code and combination information code data stored in the level 0 memories will open any lock in the hotel. Similarly, the identification information code and the combination information code stored in the next level may be common to a group of rooms so that a key card with data corresponding to the data in a second level of memory will open any of the rooms in that group. Still another level of memory in the lock may contain an identification information code and a combination information code which is unique to that lock. A key card with corresponding identification information code and combination information code data will therefore open only one lock in the hotel.

Of course, each lock may have any number of memory levels where each memory level contains data which if matched by the data from a coded key will enable the lock to open.

Turning again to FIGS. 2A and 2B, the operation of the method in accordance with the invention may be described as follows: Initially, an identification information code and a combination information code is stored in each of the memory levels of the processor 22 with corresponding data being stored in the central console. For example, a level 0 identification information code is stored in a memory 50 and a level 0 combination information code is stored in a memory 52, a level 1 identification information code is stored in a memory 54 and a level 1 combination information code is stored in a memory 56 and so forth with the level N identification information code stored in a memory 58 and the level N combination information code stored in a memory 60.

When a coded key 14 is inserted into the lock, a key reader 20 reads the data from the coded key 14 and transfers that data to a suitable holding register 62. The particular key reader and the coded key may be an optical, magnetic, electronic or mechanical system without departing from the spirit of the invention. Such card reading systems are well known and will therefore not be further described herein.

Control logic and timing 64 is coupled to the holding register 62 and to various of the other operational elements in the functional diagram of FIG. 2. Although single leads are illustrated from such control logic and timing 64 to various operational elements and from various operational elements to the control logic and timing, it will be appreciated that each line may represent several leads to carry signals providing the operation as described herein.

The control logic and timing 64, through its coupling to the holding register 62 or key reader 20 senses when the key reader has completed reading the coded key 14 and transferring the data to the holding reqister 62. The control logic and timing 64 then receives the function information code data from the holding register and based upon that function information code, selects the particular memory level from which the lock identification information code and the lock combination information code will be obtained for comparison with the key identification information code and a test field of the key combination information code stored in the holding register 62. For example, if the function code has a value of one, then the control logic and timing 64 may be set (in effect, programmed) to select or otherwise address the level 0 identification and combination information codes. On the other hand, if the function information code has a value of two, then the control logic and timing 64 may be set to select or otherwise address the level 1 identification and combination information codes. Other values of the function information code will similarly cause the control logic and timing 64 to address other memory levels for comparison with the key identification and key combination information codes in the holding register 62.

After a particular memory level has been selected the control logic and timing 64 enables the lock identification information code from that memory level to be transferred to an identification code comparator 66 where it is compared with the key identification information code from the holding register 62. If the selected lock identification information code corresponds to the key identification information code an ID compare signal is generated and sensed by the control logic and timing 64. If an ID compare signal (which could, e.g., involve a change in level, e.g., a pulse, along the electrical connection or other indication) is not received by the control logic and timing 64 the control logic and timing 64 will power down the lock 12 for a period of time.

On the other hand, if there is correspondence between the selected lock identification, information code and the key identification information code the control logic and timing 64 will transfer the lock combination information code from the same selected memory level to a test combination code comparator 68 where it is compared with the test field of the key combination information code from the holding register 62. If the selected lock combination information code corresponds to the test field of the key combination information code then a first opening compare signal (which could, e.g., again involve a change in level, e.g., a pulse, along the electrical connection or other such indication) will be generated by the test combination code comparator and sensed by the control logic and timing 64 whereupon an open lock signal (which could well, e.g., be the same type of indication just noted for the opening compare signal) will be transferred to the lock bolt assembly 24 enabling the lock bolt assembly 24 to open. If the first opening compare signal is not generated the control logic and timing will generate a signal which enables the operation select information code to address one of a number of storage locations in an operation selection memory 70, such code, of course, determining the location addressed. Such storage locations contain operation information codes for various operation alternatives which may be performed on the operand field of the key combination information code.

An operator logic and memory 72 is set (in effect, programmed) to provide the differing alternatives which may be selected by the different operation information codes stored in the operation select memory 70 storage locations. Each selection might be one or any number of arithmetic, logical or other operations. For example, one selection might be the addition of the operand field of the key combination information code to a stored number, its subtraction from a stored number or its division or multiplication by a stored number (with a possible truncation of overflow bits in some cases). Another selection might be the rotation (circular) of the operand field bits a set number of positions to the left or right. A third selection might be the inversion of certain of the operand field bits. Another selection might incorporate two or all three of these in a selected order or a number of the first group in a selected order, etc. As may be appreciated, the availability of alternatives, selected in accordance with an operation select information code provided on the coded key 14 produces a substantial measure of added security for the system.

The control logic and timing 64 thus generates signals which enable the operation selection in accordance with the operation information code from the operation selection memory 70, the transfer of the operand field of the key combination information code, on which the selection is to be performed, from the holding register 62 to the operator logic and memory 72 and the performance of the operation selection. The resulting computed combination information code is then transferred to a computed combination code comparator 74 where it is compared with the selected lock combination information code (from the selected memory level). If the computed combination information code corresponds to the selected lock combination information code a second opening compare signal (which could, e.g., again, involve a change in level, e.g., a pulse, along the electrical connection or other such indication) is sent to the control logic and timing 64 which then causes the test field of the key combination information code to be transferred to the selected memory level from the holding register 62, and replaces the selected lock combination information code with the test field of the key combination information code. In addition, the control logic and timing 64 enables the lock bolt assembly 24 to open.

By way of specific illustration, if the function information code read from the coded key 14 is a one, then the control logic and timing 64 enables the lock identification information code from the level 0 memory 50 to be transferred to the identification code comparator 66. The control logic and timing 64 also enables the key identification information code from the holding register 62 to be transferred to the identification code comparator 66. If the two identification information codes are found to correspond, the control logic and timing 64 enables the lock combination information code from the level 0 memory 52 to be transferred to the test combination code comparator 68 and further enables the test fie1d of the key combination information code from the holding register 62 to be transferred to the combination code comparator 68.

If the test field of the key combination information code and the selected lock combination information code correspond then the control logic and timing sends a signal to the lock bolt assembly 24 enabling the lock bolt assembly 24 to open. If correspondence does not exist then the control logic and timing 64 enables the selection of an operation information code from the operation selection memory 70 by the operation select information code, the operation selection in the operator logic and memory 72 in accordance with the operation information code, and the transfer of the operand field of the key combination information code to the operator logic and memory. The operation selection, made from a pre-defined set of alternative selections, is then applied to the operand field to generate a computed combination information code. The computed combination information code is then compared with the selected lock combination information code in the computed combination code comparator 74 as previously described. If correspondence occurs then the test field of the key combination information code is stored in the level 0 combination code memory and the lock bolt is opened. This storing of the test field, of course, changes the lock combination information code for that memory level to such test field.

It will be appreciated, of course, that the operand field of the key combination information code must be computed by the central console prior to being stored on the coded key 14 to assure that a correspondence will occur when the computed combination information code is compared with the lock combination information code to be selected in the lock by the key. Such computation by the console, of course, must be based on the operation selection which will be caused by the key operation select information code which the console also provides.

By way of illustration, when it is desired to generate a new combination information code for a particular level in a particular lock, the central console, typically, first generates in a random way, a test field portion for a key combination information code.

The console will then provide an operation selection from those available in the lock (information on which is stored in the console) and generate an operation select information code for the key, which will carry out this selection. The console then applies to the existing lock combination information code to be selected (which is also stored in the central console) what might be conveniently termed the "reverse" or "inverse" of the operation selection which is to be carried out in the lock. The result will be the operand field of the key combination information code. The operation select information code and the two fields of the key combination information code are then stored on the key (with the other information codes). The coded key may then be inserted in the key reader and the data transferred to the holding register 62 as previously described. The operator logic and memory 72 in the lock, at the appropriate time, will then apply the operation selection to the operand field and provide a computed combination information code which will correspond to the selected lock combination information code.

By way of specific illustration, if the operation selection to be performed by the operator logic and memory 72 is an addition of a certain number to the operand field of the key combination information code, then the operation performed by the central console to generate the operand field will be a subtraction of that number from the lock combination information code to be selected. Similarly, by way of further illustration, if the operation selection to be performed in the lock is a shift (in circular fashion) of the bits of the operand field two bits to the right, then the operation performed by the central console to generate the operand field will be a shift (in circular fashion) of the bits of the lock combination information code two bits to the left.

Figure 4:
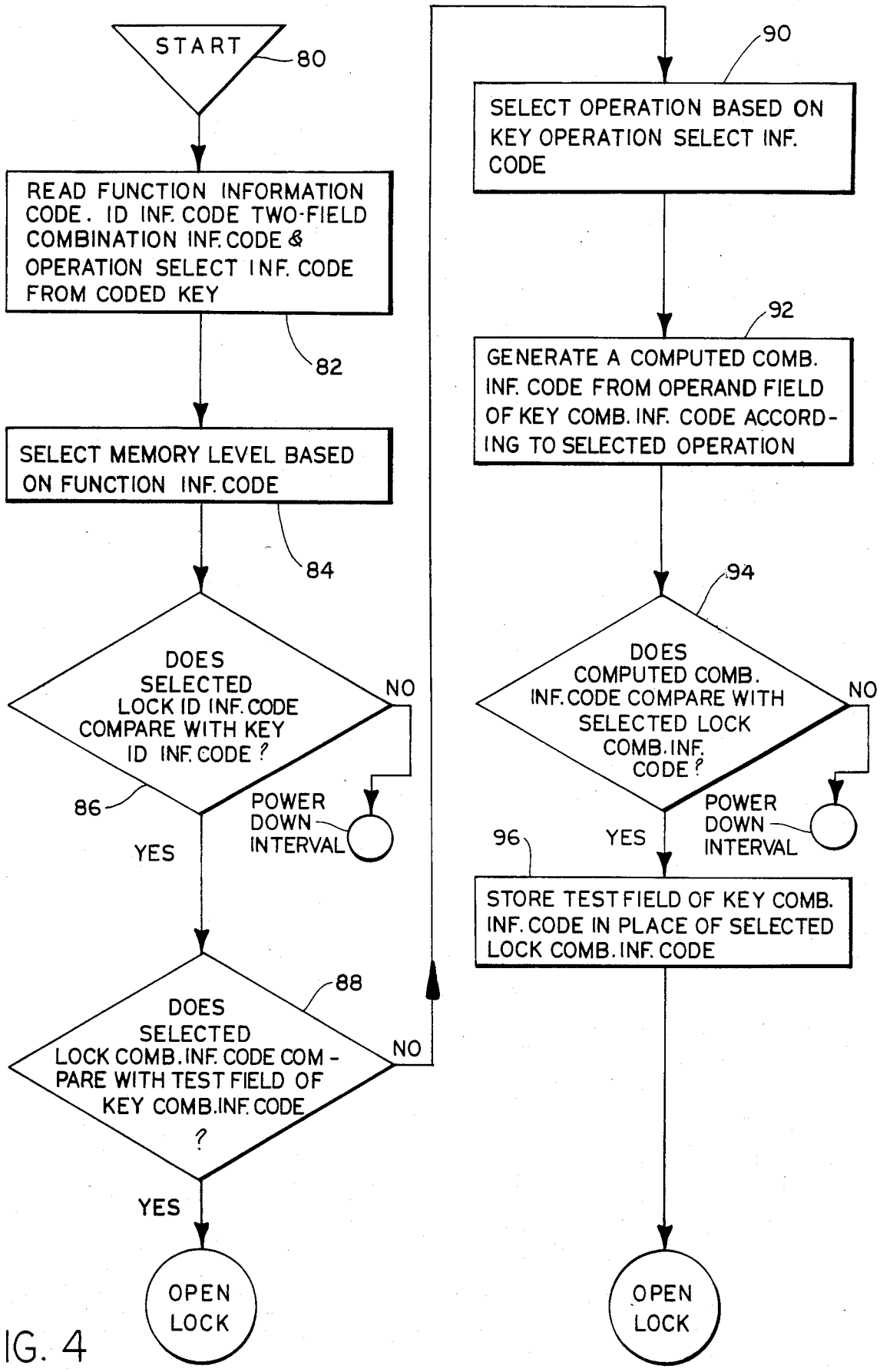
FIG. 4 is a simplified flow chart illustrative of the method in accordance with the invention.

Referring to FIG. 4, a flow chart of the above-described method is illustrated. Specifically, the lock is turned on upon the insertion of a coded key into the lock's reader (block 80). Thereafter, the function information code, identification information code, two-field combination information code and operation select information code are read from the coded key and stored in the holding register as illustrated in block 82. The particular memory level is then selected based upon the function information code in block 84. The lock processor then compares the identification information code from the selected memory level of the lock with the identification information code from the coded key. If correspondence does not exist, then the lock power is turned off for a set period of time. If correspondence does exist, then the processor compares the lock combination information code from the selected memory level of the lock with the test field of the key combination information code from the coded key (block 88). If correspondence exists, then the lock opens. However, if correspondence does not exist, then additional steps are undertaken to determine whether the lock is to open and the combination information code in the selected memory level of the lock is to be changed. Accordingly, in block 90, an operation selection is made in the lock from the predefined set of alternative selections, based on the key operation select information code; and in block 92, a computed combination information code is generated by applying the operation selection to the operand field of the key combination information code. The computed combination information code (as temporarily stored in a suitable scratch pad memory location) is then compared with the selected lock combination information code (block 94). If correspondence does not exist, then the lock power is turned off for a set period of time. However, if correspondence does exist, then the test field of the key combination information code is stored in the selected memory level of the lock in place of the selected lock combination information code (block 96) and, also, the lock opens.

Figure 3:
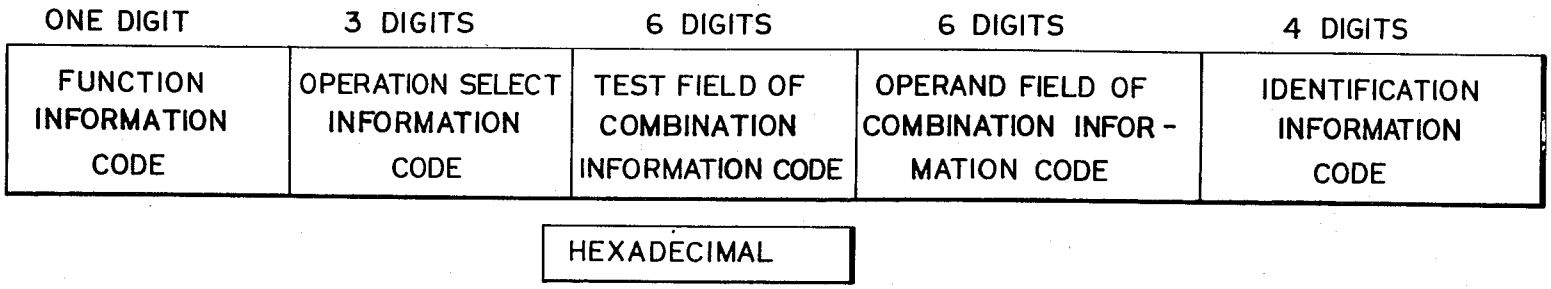
FIG. 3 is an illustration of data coded on the key and read into the security device of FIG. 2.

As a final matter, it is noted that, in FIG. 3, typical hexadecimal lengths for various key information codes are shown. In accordance with this, a "digit", as referred to therein, is four bits in length, as in conventional hexadecimal fashion. Such code lengths, of course, can readily be varied in accordance with varying requirements.

What is claimed is:

1. A method of operating an electronic security device having multiple memory levels, comprising the stpes of:

(a) storing a lock combination information code in each of the multiple memory levels;

(b) applying a key operation select information code and a key combination information code to the security device:

(c) selecting one of the memory levels having stored therein a lock combination information code;

(d) comparing combination inforamation from the selected lock combination information code with combination information dependent upon the key conbination information code and generating a first opening compare signal if said combination information from the selected lock combination information code corresponds to said combination information dependent upon the key combination information code;

(e) opening the security device if the first opening compare signal is generated;

(f) selecting, based upon the key operation select information code, from a set of predefined operations for transforming combination information to a plurality of alternative new combination information codes:

(g) applying the operation selection to information from the key conbination information code to generate a new, computed combination information code if, in response to said comparing of said comparing step, the first opening compare signal is not generated;

(h) comparing the new, computed combination information code with information from the selected lock combination information code and generating a second opening compare signal if the computed combination information code corresponds to said information from the lock combination information code; and (i) opening the security device if the second opening compare signal is generated.

2. The electronic security device operating method of claim 1 comprising the additional step of:

storing combination information dependent upon the key combination information code in the selected memory level in place of the selected lock combination inforamtion code if the second opening compare signal is generated.

3. The electronic security device operating method of claim 1 wherein:

(j) said key combination information code includes first and second code fields;

(k) in said comparing step (d), combination information dependent upon said first code field is compared with the selected lock combination information code.

(l) in said applying step (g), said operation selection is applied to said second code field to generate the new, computed combination information code; and (m) in said comparing step (h), the new, computed combination information code is compared with the lock combination information code.

4. The electronic security device operating method of claim 3 comprising the additional step of:

storing combination information dependent upon the first field of the key combination information code in the selected memory level in place of the selected lock combination information code if the second opening compare signal is generated.

5. A method of operating an electronic security device having a memory in which is stored a lock combination information code, comprising the steps of:

(a) applying a key operation select information code and a key combination information code to the security device;

(b) comparing combination information from the lock combination information code with combination information dependent upon the key combination information code and generating a first opening compare signal if said combination information from the lock combination information code corresponds to said combination information dependent upon the key combination information code;

(c) opening the secutity device if the first opening compare signal is generated;

(d) selecting, based upon the key operation select information code, from a set of predefined operations for transforming combination to a plurality of alternative new combination information codes;

(e) applying the operation selection to information from the key combination information code to generate a new, computed combination information code if, in response to said comparing of said comparing step, the first opening compare signal is not generated;

(f) comparing the new, computed combination information code with information from the lock combination information code and generating a second opening compare signal if the computed combination information code corresponds to said information from the lock combination information code; and (g) opening the security device if the second opening compare signal is generated.

6. The electronic security device operating method of claim 5 comprising the additional step of:

storing combination information dependent upon the key combination information code in the security device memory in place of the lock combination information code if the second opening compare signal is generated.

7. The electronic security device operating method of claim 5 wherein:

(h) said key combination information code includes first and second code fields:

(i) in said comparing step (b), combination information dependent upon said first code field is compared with the lock combination information code;

(j) in said applying step (e), said operation selection is applied to said second code field to generate the new, computed combination information code; and (k) in said comparing step (f), the new, computed combination information code is compared with the lock combination information code.

8. The electronic security device operating method of claim 7 comprising the additional step of:

storing combination information dependent upon the first field of the key combination information code in the security device memory in place of the lock combination information code if the second opening compare signal is generated.

9. A method of operating an electronic security device having a memory in which is stored a lock combination information code and a lock identification information code, comprising the steps of:

(a) applying a key operation select information code, a key combination information code and a key identification information code to the security device;

(b) comparing the lock identification information code with information dependent upon the key identification information code and generating an identification compare signal if the lock identification information code corresponds to the information dependent upon the key identification information code;

(c) comparing combination information from the lock combination information code with combination information dependent upon the key combination information code if the identification compare signal is generated and generating a first opening compare signal if said combination information from the lock combination information code corresponds to said combination information dependent upon the key combination information code;

(d) opening the security device if the first opening compare signal is generated;

(e) selecting, based upon the key operation select information code, form a set of predefined operations for transforming combination information to a plurality of alternative new combination information codes;

(f) applying the operation selection to information from the key combination information code to generate a new, computed combination information code if the identification compare signal is generated and the first opening compare signal is not generated;

(g) comparing the new, computed combination information code with information from the lock combination information code and generating a second opening compare signal if the computed combination information code corresponds to said information from the lock combination information code; and (h) opening the security device if the second opening compare signal is generated.

10. A method of operating an electronic security device having multiple memory levels, comprising the steps of:

(a) storing a lock combination information code and a lock identification information code in each of the multiple memory levels;

(b) applying a key operation select information code, a key combination information code and a key identification information code to the security device;

(c) selecting one of the memory levels having stored therein a lock combination information code and a lock identification information code;

(d) comparing the selected lock identification information code with information dependent upon the key identification information code and generating an identification compare signal if the selected lock identification information code corresponds to the information dependent upon the key identification information code;

(e) comparing combination information from the selected lock combination information code with combination information dependent upon the key combination information code if the identification compare signal is generated and generating a first opening compare signal if said combination information from the selected lock combination information code corresponds to said combination information dependent upon the key combination information code:

(f) operning the security device if the first opening compare signal is generated;

(g) selecting, based upon the key select information code, from a set of predefined operations for transforming combination information to a plurlaity of alternative new combination information codes;

(h) applying the operation selection to information from the key combination information code to generate a new, computed combination information code if the identification compare signal is generated and the first opening compare signal is not generated;

(i) comparing the new, computed combination information code with information from the selected lock combination information code and generating a second opening compare signal if the computed combination information code corresponds to said information from the lock combination information code; and (j) opening the security device if the second opening compare signal is generated.

* * * * *